US008907936B2

(12) United States Patent
Mizusako

(10) Patent No.: US 8,907,936 B2
(45) Date of Patent: Dec. 9, 2014

(54) LIQUID CRYSTAL DISPLAY, CONTROL METHOD THEREOF AND ELECTRONIC DEVICE WITH REDUCED FLICKER

(75) Inventor: Kazuhisa Mizusako, Chino (JP)

(73) Assignee: Seiko Epson Corporation, Tokyo (JP)

( * ) Notice: Subject to any disclaimer, the term of this patent is extended or adjusted under 35 U.S.C. 154(b) by 1013 days.

(21) Appl. No.: 12/792,939

(22) Filed: Jun. 3, 2010

(65) Prior Publication Data

US 2010/0309183 A1 Dec. 9, 2010

(30) Foreign Application Priority Data

Jun. 3, 2009 (JP) ..... 2009-133790

(51) Int. Cl.
*G09G 5/00* (2006.01)
*G09G 3/36* (2006.01)

(52) U.S. Cl.
CPC ..... *G09G 3/3648* (2013.01); *G09G 2300/0876* (2013.01); *G09G 2310/061* (2013.01); *G09G 2320/0204* (2013.01); *G09G 2320/0247* (2013.01)
USPC ..... 345/208

(58) Field of Classification Search
CPC ..... G09G 2330/025; G09G 3/3696
USPC ..... 345/87, 90, 94, 95, 98
See application file for complete search history.

(56) References Cited

U.S. PATENT DOCUMENTS

| | | | | |
|---|---|---|---|---|
| 5,754,154 | A | 5/1998 | Katakura et al. | |
| 5,940,055 | A * | 8/1999 | Lee | 345/87 |
| 2004/0008170 | A1 * | 1/2004 | Makino et al. | 345/87 |
| 2006/0132418 | A1 * | 6/2006 | Morita | 345/98 |
| 2007/0164963 | A1 * | 7/2007 | Kim et al. | 345/98 |

FOREIGN PATENT DOCUMENTS

| | | |
|---|---|---|
| JP | 06-347759 | 12/1994 |
| JP | 08-286169 | 11/1996 |
| JP | 2006-106149 | 4/2006 |
| JP | 2008-107590 | 5/2008 |
| JP | 2008-298923 | 12/2008 |

* cited by examiner

*Primary Examiner* — Ram Mistry
(74) *Attorney, Agent, or Firm* — Maschoff Brennan

(57) ABSTRACT

A liquid crystal display includes liquid crystal elements in which a liquid crystal layer is sandwiched by a first electrode and a second electrode, a driving circuit configured to alternately apply higher and lower voltages than a predetermined voltage to the first electrode, and, at the same time, to apply the predetermined voltage to the second electrode, and a control circuit configured to compare a first current with a second current, the first current being obtained by excluding an instantaneous current due to a related higher voltage from currents flowing through the second electrode after the higher voltage is applied to the first electrode, and the second current being obtained by excluding an instantaneous current due to a related lower voltage from currents flowing through the second electrode after the lower voltage is applied to the first electrode, and to control the predetermined voltage based on the comparison result.

7 Claims, 11 Drawing Sheets

SCANNING LINE DRIVING CIRCUIT

DATA LINE DRIVING CIRCUIT

SCANNING LINE DRIVING CIRCUIT

DATA LINE DRIVING CIRCUIT

COMMON SIGNAL CURRENT WAVEFORM

TRANSMITTANCE (CAPACITANCE) VARIATION

SCANNING LINE DRIVING CIRCUIT

DATA LINE DRIVING CIRCUIT

COMMON SIGNAL CURRENT WAVEFORM

SCANNING LINE DRIVING CIRCUIT

COMMON SIGNAL CURRENT WAVEFORM

LPF OUTPUT WAVEFORM

LIQUID CRYSTAL DISPLAY, CONTROL METHOD THEREOF AND ELECTRONIC DEVICE WITH REDUCED FLICKER

BACKGROUND

1. Technical Field

The present invention relates to a technique which can prevent flicker or the like in a liquid crystal display.

2. Related Art

Liquid crystal elements, which can be used in a liquid crystal display ("LCD"), enable a liquid crystal layer to be sandwiched by two electrodes, but the liquid crystal layer is applied with a direct current ("DC") component, which deteriorates the liquid crystal layer. For this reason, in the LCD, an alternating current ("AC") driving is performed in which one electrode is alternately applied with a higher voltage and a lower voltage than a voltage applied to the other electrode.

A difference in the voltage effective values at this time makes flicker recognized, and a technique is known which prevents the deterioration of the liquid crystal layer by forming a light sensing element such as a photodiode or the like on a panel or in the vicinity thereof and further by adjusting the voltage applied to the other electrode so that a difference in transmittance (or reflectance) is minimized (FIG. 1 in JP-A-H8-286169 which is an example of related art).

However, if the light sensing element is formed, there are problems in that it has bad influence on the viewability of display images or a so-called frame is broadened, and there are also problems in that stray light inside the display device enters the light sensing element and thereby it is difficult to detect the transmittance accurately.

SUMMARY

An advantage of some aspects of the invention is to provide a technique capable of suppressing application of a DC component to a liquid crystal layer and reducing flicker, without employing a light sensing element.

An LCD according to an embodiment of the invention includes liquid crystal elements in which a liquid crystal layer is sandwiched by a first electrode and a second electrode; a driving circuit configured to alternately apply higher and lower voltages than a predetermined voltage to the first electrode, and, at the same time, to apply the predetermined voltage to the second electrode; and a control circuit configured to compare a first current with a second current, the first current being obtained by excluding an instantaneous current due to application of a related higher voltage from currents flowing through the second electrode after the higher voltage is applied to the first electrode, and the second current being obtained by excluding an instantaneous current due to application of a related lower voltage from currents flowing through the second electrode after the lower voltage is applied to the first electrode, and to control the predetermined voltage based on the comparison result. According to the invention, it is possible to suppress the application of a DC component to the liquid crystal layer and to reduce flicker without employing a light sensing element.

Here, the driving circuit may apply a reset voltage for resetting a potential between the first electrode and the second electrode before applying the higher voltage or the lower voltage. By this configuration, the voltage for the liquid crystal elements is arranged in order before the higher voltage or the lower voltage is applied thereto, and thus it is possible to obtain a current component excluding an instantaneous current with more accuracy. In addition, as the reset voltage, a voltage is preferable which leads the liquid crystal elements to an on direction when the high voltage or the low voltage is applied.

Further, the control circuit may specify the current excluding the instantaneous current due to the application of the higher voltage or the lower voltage, as a peak value appearing second from the time of the application of the higher voltage or the lower voltage, in a waveform indicating currents flowing through the liquid crystal elements. Thereby, it is possible to simplify a configuration of the control circuit, or the like.

In addition, the control circuit includes a resistor interposed in a signal line which transmits the predetermined voltage to the second electrode; and a detection circuit detecting a voltage across the resistor, wherein the control circuit may specify a current flowing through the second electrode based on the across-voltage detected by the detection circuit. Also, the control circuit may include a low pass filter filtering the across-voltage detected by the detection circuit.

In the meantime, the first electrode may be a pixel electrode which is coupled to a data line via a switching element, which is turned on when a scanning line is selected, and the second electrode may be a common electrode. The driving circuit may include a scanning line driving circuit selecting the scanning line, a data line driving circuit supplying a data signal for the data line at the selection period, and a common electrode driving circuit supplying the predetermined voltage for the common electrode, and wherein the control circuit may increase or decrease the predetermined voltage. In this configuration, the scanning line driving circuit may select the scanning line and thereafter not select the related scanning line by turning off the switching element. Thereby, it is possible to suppress the application of a DC component to the liquid crystal layer, also in consideration of a state where the switching element is turned off.

When the liquid crystal elements are disposed in an area other than a display area and the control circuit detects a current flowing through the second electrode in relation to the liquid crystal elements disposed in the area other than the display area, a display based on the voltage writing at the time of control of the common voltage is not recognized.

In addition, the invention is not limited to the LCD, but is applicable to a control method of the LCD, and further to an electronic device having the LCD.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

To begin with, a first embodiment of the invention will be described in outline.

In order to prevent seizing or deterioration of liquid crystal, an AC driving is required to be performed for a liquid crystal element in which a liquid crystal layer is sandwiched by a first electrode and a second electrode. For example, a voltage with positive polarity higher than a reference voltage (higher voltage) and a voltage with negative polarity lower than the reference voltage (lower voltage) are alternately applied to the first electrode, while a predetermined voltage is applied to the second electrode. At this time, if transmittance (or reflectance) in the liquid crystal element at a period where the voltage is applied and kept positive is different from that in the liquid crystal element at a period where the voltage is applied and kept negative, this makes flicker (blink) recognized.

Liquid crystal molecules alter their inclined arrangement depending on the electric field generated by the first electrode and the second electrode, thereby changing the polarization of light passing through the liquid crystal elements. This change of the polarization causes the variation of transmittance (or reflectance) in the liquid crystal elements. The liquid crystal layer has a dielectric anisotropy, and thereby the transmittance in the liquid crystal elements is different at the period where the voltage with positive polarity (the voltage with positive polarity is often abbreviated to a "positive voltage") is maintained and at the period where the voltage with negative polarity (the voltage with negative polarity is often abbreviated to a "negative voltage") is maintained. This means that the inclined arrangement of the liquid crystal elements is different, and in turn means that capacitance for the liquid crystal elements is different.

Therefore, if the capacitance for the liquid crystal elements is respectively detected by a certain method at the period where the positive voltage is maintained and at the period where the negative voltage is maintained, and, at the same time, if a voltage applied to the liquid crystal elements is controlled so that the detection results are not different from each other, flicker can be reduced.

However, it is difficult to directly detect the capacitance for the liquid crystal elements, and thus, in this embodiment, as described later, a capacitance for the related liquid crystal elements is indirectly found by a waveform of a current flowing through the related liquid crystal elements. Thereafter, a voltage applied to the liquid crystal elements is controlled so that the capacitances for both the polarities can be considered to be equal.

The first embodiment implements this and will now be described in detail.

Figure 1:
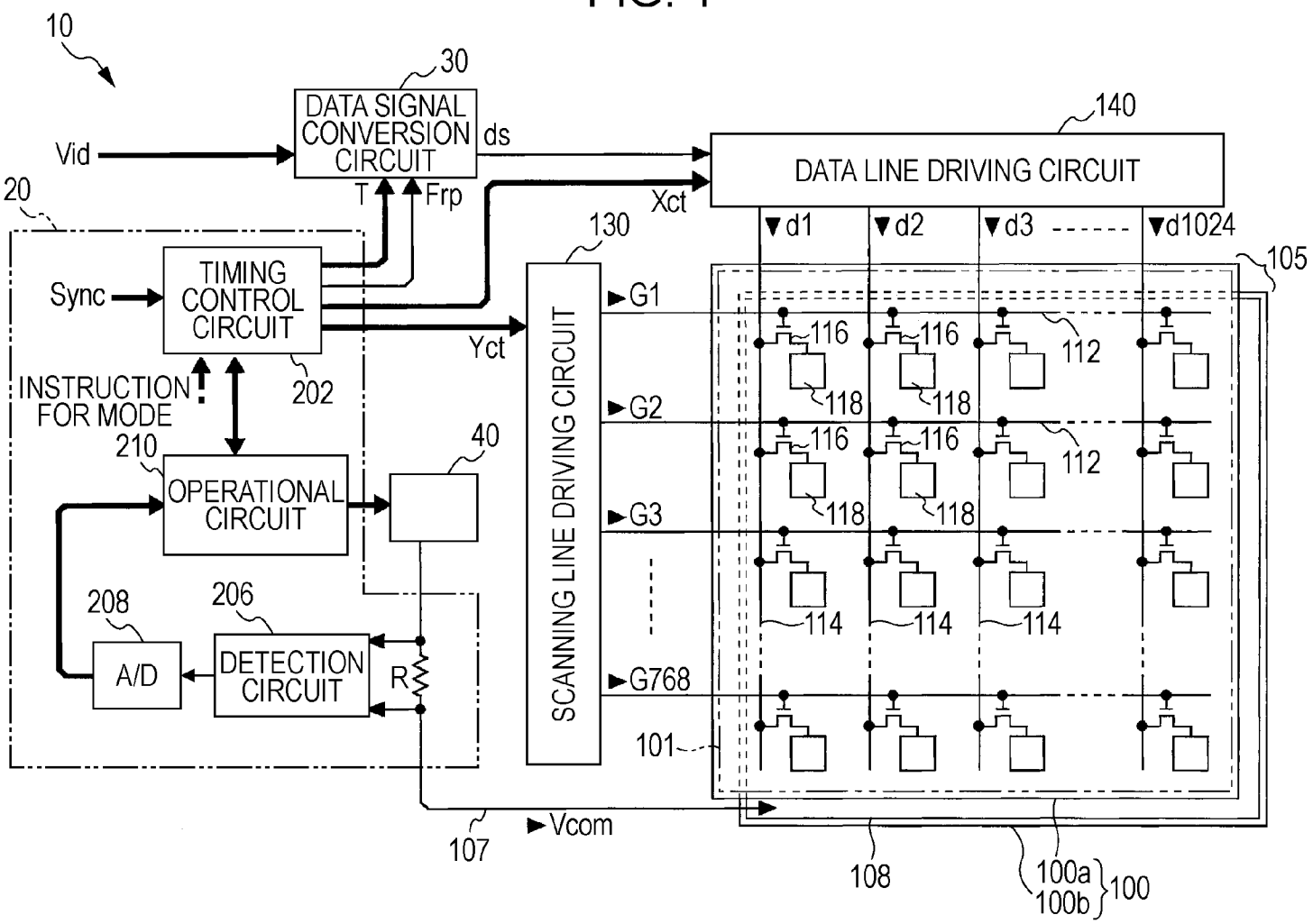
FIG. 1 is a block diagram illustrating a configuration of a liquid crystal display according to a first embodiment.

FIG. 1 is a block diagram illustrating an entire configuration of a liquid crystal display ("LCD") according to the first embodiment. As shown in this figure, an LCD 10 includes a control circuit 20, a data signal conversion circuit 30, a common electrode driving circuit 40, a panel assembly 100, a scanning line driving circuit 130, and a data line driving circuit 140.

The LCD 10 has two operation modes, a display mode where the panel assembly 100 performs display based on a video signal Vid supplied from an external device (not shown), and an adjustment mode where a voltage applied to the liquid crystal elements is adjusted to reduce flicker.

It is expected that the operation mode is in principle set to the display mode, but exceptionally is transferred to the adjustment mode, for example, in a sequence immediately after the LCD is powered on or immediately before it is powered off. Also, it is expected that the operation mode is forced to be transferred to the adjustment mode after elapse of a predetermined time in the display mode, and, when an operation section is disposed and a user operates the operation section, it is transferred to the adjustment mode and so on. In the meantime, in the LCD 10, the control circuit 20 (a timing control circuit 202) controls the respective elements in response to the operation mode instructed by an external device or an operation of the operation section.

For convenience of description, a configuration of the panel assembly 100 will be described. The panel assembly 100 has an element panel 100*a* and an opposite panel 100*b*, which are attached to each other with a constant gap therebetween, and a liquid crystal layer 105 is sealed in the gap.

On a plane of the element panel 100*a* opposite to the opposite panel 100*b*, scanning lines 112 of 768 rows are arranged extending in the transverse direction in the figure and data lines 114 of 1024 columns are arranged extending in the longitudinal direction therein, which are provided so as to be electrically insulated with the respective scanning lines 112. In order to distinguish scanning lines 112 from each other, they are hereinafter also referred to as scanning lines in the 1st, 2nd, 3rd, . . . , and 768th row from above in the figure. In the same manner, in order to distinguish the data lines 114 from each other, they are also referred to as data lines in the 1st, 2nd, 3rd, . . . , and 1024th column rightwards in the figure.

The element panel 100*a* is provided with plural sets of n channel type thin film transistors (hereinafter, abbreviated to "TFTs") 116 which function as switching elements, and pixel electrodes 118 which function as the first electrodes and are transparent with a tetragonal shape, at the respective intersections of the scanning lines 112 and the data lines 114. Gate electrodes of the TFTs 116 are connected to the scanning lines 112, source electrodes thereof to the data lines 114, and drain electrodes thereof to the pixel electrodes 118.

A plane of the opposite panel 100*b* opposite to the element panel 100*a* is provided with common electrodes 108 which function as the second electrodes and are transparent. The scanning lines 112, the data lines 114 and the TFTs 116, and pixel electrodes 118 are actually placed on the rear face of the element panel 100*a* in FIG. 1 and thus they are marked with broken lines, but, for easy recognition, they are marked with the solid lines.

Figure 2:
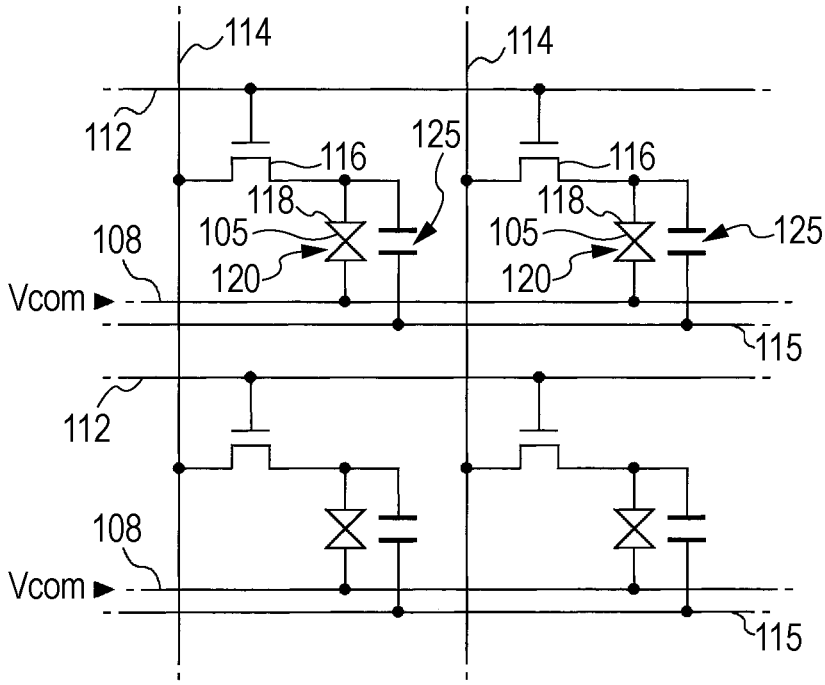
FIG. 2 is a diagram illustrating a configuration of pixels in the same liquid crystal display.

The equivalent circuit for the panel assembly 100 is like that shown in FIG. 2, and the liquid crystal elements 120 are provided at the intersections of the scanning lines 112 and the data lines 114, and enables the liquid crystal layer 105 to be sandwiched by the pixel electrodes 118 and the common electrodes 108.

In the liquid crystal element 120, a voltage between the pixel electrode 118 and the common electrode 108 is maintained, and a molecule arrangement of the liquid crystal layer 105 is varied depending on the electric field generated by both the electrodes. Thereby, the liquid crystal element 120, if it is of a transmissive type, has transmittance corresponding to an effective value of a voltage which is applied and maintained.

The transmittance is varied in each liquid crystal element 120 in the panel assembly 100, and hence the liquid crystal element 120 corresponds to a pixel. An area where these pixels are arranged is a display area 101.

Although not shown in FIG. 1, the equivalent circuit for the panel assembly 100 actually includes an auxiliary capacitors (storage capacitors) 125 in parallel with the liquid crystal elements 120, as shown in FIG. 2. Each of the auxiliary capacitors 125 has one end connected to the pixel electrodes 118 and the other end commonly connected to capacitance lines 115. The capacitance lines 115 are maintained to be a predetermined voltage which is temporally constant.

Here, in the display mode, the scanning lines are selected in a predetermined order, and selection voltages are applied to the selected scanning lines 112, thereby turning on the TFTs 116 in the selected scanning lines 112. Data signals with voltages corresponding to desired grayscales are supplied for the liquid crystal elements 120 related to the selected scanning lines 112 via the data lines 114, and the associated data signals are applied to the pixel electrodes 118 via the turned-on TFTs 116. Thereby, the liquid crystal elements 120 are applied with voltages corresponding to differences between the voltages applied to the pixel electrodes 118 and the common electrodes 108. Even when the TFTs 116 are turned off due to the application of non-selection voltages to the scanning lines, the voltages applied to the liquid crystal elements 120 when the TFTs 116 are turned on are maintained due to their capacitive characteristics.

The data signals with the voltages corresponding to the grayscales are supplied for the liquid crystal elements 120 placed in the selected scanning lines via the data lines 114, and thereby the associated pixels are made to represent desired transmittance.

In addition, in this embodiment, the liquid crystal elements 120 have a normally black mode where the transmittance is increased as the maintained voltage is heightened.

In order to prevent a DC component from being applied to the liquid crystal layer 105, for the voltage of the data signal, a positive voltage higher than a video amplitude central voltage (reference voltage) Vc and a negative voltage lower than that may be alternately changed every frame period. This reference voltage Vc is fixed, whereas a voltage Vcom (predetermined voltage) applied to the common electrode 108 is nearly the same value as that in the initial step although it is varied in the adjustment mode described later.

Also, the frame period refers to a period needed to display an amount of one frame of images when the panel assembly 100 is driven in the display mode, and, if a vertical scanning frequency defined in a vertical synchronization signal is 60 Hz, it is 16.7 ms which corresponds to a reciprocal thereof.

For the applied and maintained voltage in the liquid crystal element 120, a voltage difference between the pixel electrode 118 and the common electrode 108 is mentioned, but, for a voltage such as a voltage developed across a resistor R described later or the like, as long as not mentioned especially, a ground voltage of a power supply (not shown) is a reference for a voltage zero.

In the display mode, for a spatial arrangement of polarity for writing in the pixels over one frame period, in this embodiment, the same writing polarity is designated for all the pixels over the same frame period, and further a frame inversion method is employed where the writing polarity is reversed every frame period. In addition to the frame inversion method, there is a row inversion method of reversing the aforementioned every scanning line, a column inversion method of reversing the aforementioned every data line, a pixel inversion method of reversing the aforementioned every pixel neighboring in the scanning line and the data line directions, and so on, but the invention is applicable to any inversion methods.

In the meantime, this LCD 10 is supplied with a digital video signal Vid from an external device (not shown). This video signal Vid is digital data for allocating brightness (grayscale) to each pixel in the panel assembly 100, and is supplied for each pixel in an order scanned based on synchronization signals Sync (vertical synchronization signal, horizontal synchronization signal and dot clock signal).

The data signal conversion circuit 30 outputs a data signal ds in response to a mode instructed by the timing control circuit 202. In detail, the data signal conversion circuit 30, in the display mode, converts the digital video signal Vid into an analog data signal ds with polarity designated by a signal Frp relative to the reference voltage Vc, and, in the adjustment mode, it outputs a signal with a voltage described later as the data signal ds, irrespective of the video signal Vid.

The common electrode driving circuit 40 is, for example, a D/A conversion circuit or the like, and applies the common voltage Vcom to the common electrode 108 via the signal line 107. Here, the common electrode driving circuit 40, in the adjustment mode, increases or decreases the common voltage Vcom by one step at a time in response to an instruction from an operational circuit 210, and, in the display mode, it maintains a voltage which has been set finally in the adjustment mode.

The control circuit 20 includes the timing control circuit 202, a detection circuit 206, an A/D conversion circuit 208, the operation circuit 210, and a resistor R.

Among these, responsive to the operation mode, the timing control circuit 202 controls each of the data signal conversion circuit 30, the scanning line driving circuit 130, the data line driving circuit 140, and the operational circuit 210. Control contents of the timing control circuit 202 will be described in detail in its operation.

The resistor R is interposed in the signal line 107. For this reason, a voltage proportional to a current flowing through the signal line 107 is developed across the resistor R.

The detection circuit 206 detects a voltage across the resistor R for amplification. The A/D conversion circuit 208 converts the voltage detected and amplified by the detection circuit 206 into digital data for output to the operational circuit 210.

If the voltage indicated by the digital data is respectively divided by a resistance of the resistor R and a voltage gain rate in the detection circuit 206, a current value flowing through the signal line 107 can be calculated, but, in this embodiment, as described later, it is important whether a difference between current values (values reflecting the current values) lies in a threshold value or not, and thus the calculation regarding the current value itself is not necessary. In addition, a sampling rate (sampling frequency) in the A/D conversion circuit 208 is set to a sufficiently high value relative to the variation of the voltage detected and amplified by the detection circuit 206.

The operational circuit 210 includes, for example, a programmable logic circuit or the like, and, in the display mode, hardly performs characteristic operations. However, in the adjustment mode, it analyzes currents flowing at the positive polarity and the negative polarity by the use of the digital data from the A/D conversion circuit 208, and gives an instruction based on the analyzed result to the common electrode driving circuit 40. An operation of the operational circuit 210 will be described later in detail.

Next, an operation of the LCD will be described.

To begin with, an operation in the display mode will be described. In the display mode, the timing control circuit 202 controls the respective elements in response to the synchronization signals Sync supplied from an external device.

Figure 3A:
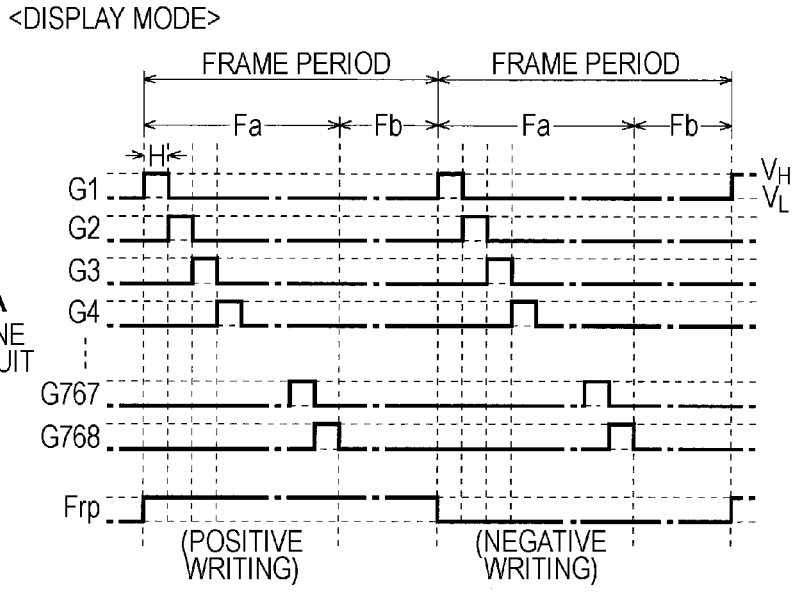
FIGS. 3A and 3B are diagrams illustrating an operation in a display mode in the same liquid crystal display.

In detail, the timing control circuit 202, in the display mode, controls the scanning line driving circuit 130 using a control signal Yct so that the scanning lines 112 are selected sequentially one by one every horizontal scanning period from a start timing of the vertical scanning period (frame period) defined by the synchronization signals Sync. Thereby, the respective scanning signals G1 to G768 exclusively become selection signals $V_H$ with a high (H) level in order every horizontal scanning period (H), as shown in FIG. 3A. In addition, low (L) levels of the scanning signals correspond to non-selection voltages $V_L$. In the same figure, the reference sign Fa denotes a vertical valid scanning period, and, the reference sign Fb denotes a vertical blanking period.

Meanwhile, the timing control circuit 202, in the display mode, supplies the signal Frp for the data signal conversion circuit 30. Here, the signal Frp designates polarity of the data signal ds, and, for example, its H level designates the positive polarity and its L level designates the negative polarity. Since this embodiment employs the frame inversion method, as described above, the logic level of the signal Frp is reversed every frame period.

The timing control circuit 202, in the display mode, controls the data line driving circuit 140 using a control signal Xct so that the data signal ds converted during the horizontal scanning period is sampled in the data lines 114 in amounts of one pixel in an order of 1, 2, 3, . . . , 1024 columns, from the start timing of the horizontal scanning period.

The video signal Vid is supplied in an order of pixels of 1 row by 1 column to 1 row by 1024 column, 2 row by 1 column to 2 row by 1024 column, 3 row by 1 column to 3 row by 1024 column, . . . , and 768 row by 1 column to 768 row by 1024 column, during one frame period.

Here, at a frame period where the positive polarity writing is designated when the signal Frp becomes the H level, during the horizontal scanning period when the video signal Vid for 1 row by 1 column to 1 row by 1024 column is supplied, the related video signal Vid is converted into the data signal ds with the positive polarity by the data signal conversion circuit 30, and, at the same time, the related data signal ds is sampled as data signals d1, d2, d3, . . . , d1024 in the data lines 114 in the 1st, 2nd, 3rd, . . . , and 1024th columns by data line driving circuit 140.

In the meantime, during the related horizontal scanning period, only the scanning signal G1 becomes the H level by the scanning line driving circuit 130, and thereby the TFTs 116 in the first row are turned on. Thereby, the data signals sampled in the data lines 114 are applied to the pixel electrodes 118 via the turned-on TFTs 116, and in turn voltages, with positive polarity, corresponding to the grayscales are respectively written in the liquid crystal elements 120 in 1 row by 1 column to 1 row by 1024 column.

Subsequently, during the horizontal scanning period where the video signal Vid for 2 row by 1 column to 2 row by 1024 column is supplied, in the same manner, the related video signal Vid is converted into the data signal ds with positive polarity, and, at the same time, the related data signal ds is sampled in the data lines 114. Meanwhile, since only the scanning signal G2 becomes the H level, the TFTs 116 in the second row are turned on. Thereby, the data signals sampled in the data lines 114 are applied to the pixel electrodes 118, and thus voltages, with positive polarity, corresponding to the grayscales are respectively written in the liquid crystal elements 120 in 2 row by 1 column to 2 row by 1024 column. Below a similar writing operation is performed according to the 3rd, 4th, . . . , 768th column.

During the following frame period, the signal Frp becomes the low level so that the negative polarity writing is designated, and the same writing operation is repeated except for conversion of the video signal Vid into the data signal ds with negative polarity. Thereby, voltages, with negative polarity, corresponding to the respective grayscales, are written in the respective liquid crystal elements.

In the display mode, images corresponding to the video signal Vid are displayed on the panel assembly 100 by such voltage writing.

Figure 3B:
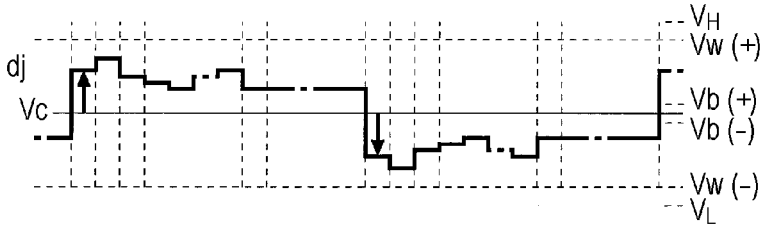

FIG. 3B shows a voltage variation in the data signal dj sampled in j-th data line 114, by the use of j (where j is 1 to 1024) for general description without specifying columns. In this embodiment, the liquid crystal elements 120 have the normally black mode, and thus, for example, at the horizontal scanning period where the scanning signal G1 becomes the H level, if the data signal dj is positive, it has a higher voltage than the reference voltage Vc by an amount corresponding to a grayscale for 1 row by j column (marked with ↑ in the figure), and if negative, it has a lower voltage than the reference voltage Vc by an amount of a grayscale for 1 row by j column (marked with ↓ in the figure).

For the voltages of the data signal, if the positive polarity is designated, the voltages are deviated, by an amount corresponding to a grayscale, from the reference voltage Vc in a range from the voltage Vw(+) corresponding to the white to the voltage Vb(+) corresponding to the black. If the negative polarity is designated, the voltages are deviated, by an amount corresponding to a grayscale, from the reference voltage Vc in a range from the voltage Vw(−) corresponding to the white to the voltage Vb(−) corresponding to the black. The voltage Vw(+) and the voltage Vw(−) are symmetric with respect to the reference voltage Vc. This is the same for the voltages Vb(+) and Vb(−).

The longitudinal scale for the voltage of the data signal in FIG. 3B is expanded compared with the voltage waveforms for the scanning signals in FIG. 3A.

In the meantime, in an ideal LCD, flicker is not generated when the positive polarity and the negative polarity are alternately driven, but, in an actual LCD, the flicker is generated due to various factors such as a difference in electrical characteristics in the common electrode side and the pixel electrode side, or the like.

The reason why the flicker is generated is that transmittance at the positive voltage maintaining period is different from that at the negative voltage maintaining period. For this reason, a technique is considered in which a light sensing element is disposed on the panel assembly or in the vicinity thereof, the transmittance for each polarity is detected, and there is no difference in the detected transmittances; however, it cannot be employed for the reason described in the related art.

The difference in the transmittances for the liquid crystal elements means, as described above, that capacitances for the liquid crystal elements are different, but it may be difficult to directly detect the capacitances for the liquid crystal elements.

Therefore, in the following adjustment mode in this embodiment, the liquid crystal elements 120 are driven as follows, so that a value corresponding to the capacitance for the liquid crystal elements is indirectly found out from a waveform of a current flowing through the related liquid crystal elements.

First, this adjustment mode will be described.

Figure 4A:
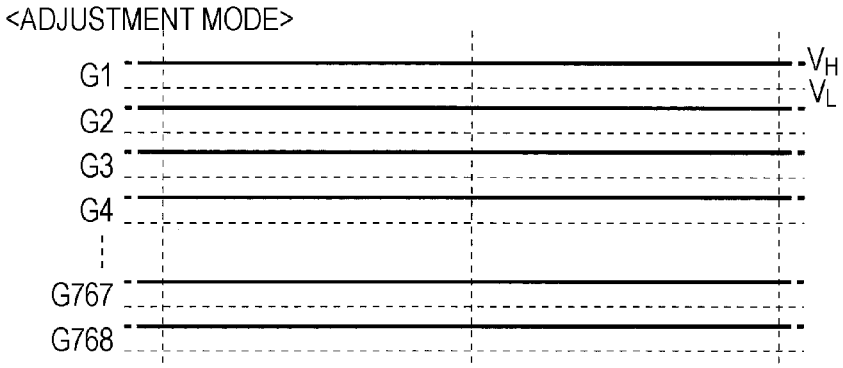
FIGS. 4A to 4D are diagrams illustrating an operation in an adjustment mode in the same liquid crystal display.

In the adjustment mode, the timing control circuit 202 controls the scanning line driving circuit 130 using the control signal Yct so as to select all the scanning lines 112 irrespective of the synchronization signals Sync. Thereby, all the scanning signals G1 to G768 become the selection voltage $V_H$ with the H level as shown in FIG. 4A.

Meanwhile, in the adjustment mode, the timing control circuit 202 enables the period to be circulated in an order of Ta→Tb→Tc→Td→(Ta). The timing control circuit 202 supplies a control signal T indicating one of the durations Ta, Tb, Tc, and Td for the data signal conversion circuit 30. The data signal conversion circuit 30, in the adjustment mode, designates the voltage of the data signal ds, as a positive intermediate grayscale voltage Vg(+) at the duration Ta, as the voltage Vc at the duration Tb, as a negative intermediate grayscale voltage Vg(−) at the duration Tc, and as the voltage Vc at the duration Td, irrespective of the video signal Vid.

In addition, this adjustment mode is irrespective of the synchronization signals Sync, and thus a changing frequency for the durations Ta to Td is preferably lower than the horizontal synchronization frequency (60 Hz).

The timing control circuit 202, in the adjustment mode, controls the data line driving circuit 140 using the control signal Xct so as to supply the data signal ds for all the data lines 114 collectively.

Figure 4B:
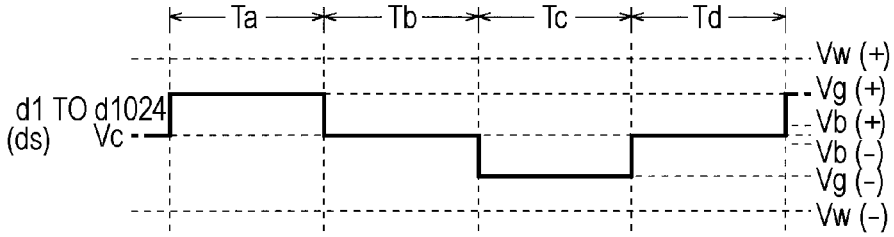

Thereby, the data signals d1 to d1024 by data line driving circuit 140 are all the same as the data signal ds, as shown in FIG. 4B, that is, become the voltage Vg(+) at the duration Ta, the voltage Vc at the duration Tb, the voltage Vg(−) at the duration Tc, and the voltage Vc at the duration Td, and thereafter the waveform at the durations Ta to Td is repeated.

Here, the voltage Vg(+) is a positive voltage corresponding to an intermediate grayscale between the white and the black, and the voltage Vg(−) is a negative voltage corresponding to an intermediate grayscale therebetween.

In the panel assembly 100, all the scanning signals G1 to G768 are in the H level, and in turn all the TFTs 116 in all the rows by columns are turned on.

Thereby, in the adjustment mode, the data signal ds is respectively supplied for all the pixel electrodes 118 collectively. The data signal ds, as shown in FIG. 4*b*, is varied every duration Ta, Tb, Tc, and Td, and thereby currents flow through the liquid crystal elements 120 due to the change of the voltages of the data signals applied to the pixel electrodes 118. At this time, a current corresponding to values obtained by totally summing the currents flowing through the respective liquid crystal elements 120 flows through the signal line 107.

Figure 4C:
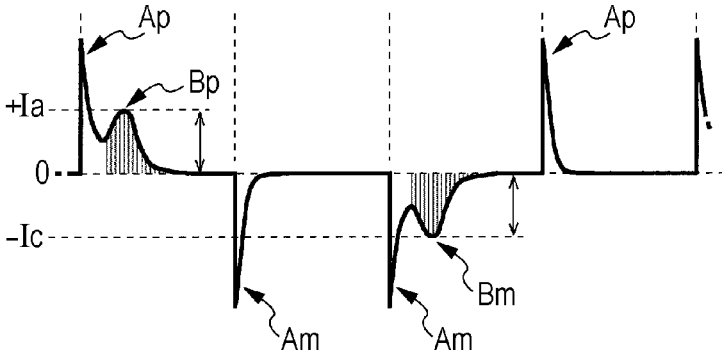

The sum total of the current flowing through the signal line 107 is converted into a voltage using the resistor R, and the associated voltage is detected by the detection circuit 206. A waveform of the voltage (a waveform of the current) detected at this time is thought of as shown in FIG. 4C. This reason will be described in detail.

Figure 4D:
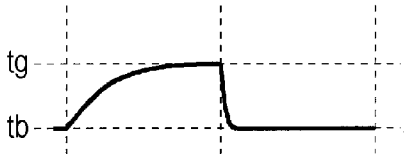

First, when the voltage applied to the pixel electrode 118 is changed from the voltage Vc to Vg(+) at the start timing of the duration Ta, the voltage applied to the liquid crystal element 120 (a difference between a voltage applied to the related pixel electrode and a voltage applied to the common electrode) is instantaneously varied with respect to the corresponding change, whereas the transmittance which is an optical response is varied considerably slowly as shown in FIG. 4D (several microseconds are taken until the transmittance is saturated). That is to say, it is integrally varied from the transmittance Tb corresponding to the black to the transmittance Tg corresponding to the intermediate grayscale.

The capacitance for the liquid crystal element 120 is varied depending on arrangement state (inclination) of the liquid crystal molecules which are dielectrics and interposed between the pixel electrode 118 and the common electrode 108, and this inclination determines the transmittance. Thereby, the capacitance for the liquid crystal element 120 is thought to be varied substantially in the same manner as the transmittance.

When the capacitance for the liquid crystal element 120 is varied in the same manner as the transmittance shown in FIG. 4D, the waveform of the currents flowing through the liquid crystal elements 120, as shown in FIG. 4C, shows an instantaneous current flowing transitionally, that is, a first peak Ap with a differentiated waveform due to the change to a direction where a potential for the pixel electrode 118 is increased relative to the common electrode 108 at the start timing of the duration Ta, and a second peak Bp due to the capacitance variation (thought to be substantially the same as the transmittance variation) in the liquid crystal elements from the start timing of the duration Ta.

Likewise, the current waveform shows a first peak Am with a differentiated waveform due to the change to a direction where a potential for the pixel electrode 118 is decreased relative to the common electrode 108 at the start timing of the duration Tc, and a second peak Bm due to the capacitance variation in the liquid crystal elements from the start timing of the duration Tc.

In addition, the waveform of the current flowing through the liquid crystal elements 120 shows only the first peak Am at the start timing of the duration Tb. Likewise, it shows only the first peak Ap at the start timing of the duration Td.

This is because the liquid crystal layer 105 is assumed to have features that the optical response when the applied voltage is varied in a direction of increase (on direction) in view of an absolute value is slower than that when it is varied in a direction of decrease (off direction), and further the optical response at the time of the variation in the off direction is sufficiently fast, and thus the second peaks Bp and Bm do not appear (difficult to appear) at the start timings of the durations Tb and Td where the applied voltage is varied in the off direction.

Here, the current waveform components (a first current and a second current) excluding the first peak Ap(Am) at the duration Ta(Tc), that is, the components marked with the hatching in FIG. 4C are components generated due to the capacitance variation in the liquid crystal elements 120. The capacitance variation in the liquid crystal elements 120 corresponds to the transmittance variation, and thus the current waveform component excluding the first peak Ap(Am) reflects the transmittance variation.

Consequently, it is favorable to adjust the common voltage Vcom so that the current waveform component excluding the first peak Ap at the duration Ta corresponds with that excluding the first peak Am at the duration Tc.

Here, the current waveform component excluding the first peak Ap(Am) at the duration Ta(Tc) is reflected as a peak value of the second peak Bp(Bm). For this reason, in this embodiment, the current waveform component excluding the first peak Ap(Am) at the duration Ta(Tc) is specified as a peak value of the second peak Bp(Bm) and further the common voltage Vcom is adjusted so that this peak value lies in a threshold value.

In the current waveform (voltage waveform) in FIG. 4C, the zero point is important. Here, if the voltage of the data signal ds and the common voltage Vcom are temporally constant, the current flowing through the signal line 107 is expected to be zero. Thereby, in the adjustment mode, the voltage of the data signal ds and the common voltage Vcom are all made to be constant only during a predetermined duration, and it is good to use, as a current zero point, an output value of the detection circuit 206 in this constant state.

In order to compare the current waveform component (or peak value) excluding the first peak Ap at the duration Ta with the current waveform component (or peak value) excluding the first peak Am at the duration Tc (or peak value), conditions before application of voltages to the liquid crystal elements are preferably arranged in order. Therefore, a voltage identical to the voltage Vcom applied to the common electrode 108 is applied to the pixel electrode 118, as a reset voltage, at the duration Td before the duration where the positive voltage Vg(+) is applied to the pixel electrode 118 and at the duration Tb before the duration where the negative voltage Vg(−) is applied thereto, respectively, so that a driving voltage for the liquid crystal element 120 is set to zero for the arrangement in order.

Also, for example, if the voltage applied to the liquid crystal element 120 is set to be high by applying, to the pixel electrode 118, the voltages Vw(+) and Vw(−) corresponding to the white as the reset voltage in the normally black mode, a direction of variation becomes the off direction where the optical response is sufficiently fast, and this causes the second peak difficult to appear. In other words, if a voltage by which the voltage applied to the liquid crystal element 120 is set to be low is applied to the pixel electrode 118 as the reset voltage, this causes the variation in the on direction and thus the second peak can be easily specified.

In this meaning, as the reset voltage, the voltages Vb(+) and Vb(−) corresponding to the black may be applied to the pixel electrode 118.

The voltage detected by the detection circuit 206 (the voltage converted from the current flowing through the signal line 107) is converted into digital data by the A/D conversion circuit 208 and supplied for the operational circuit 210.

The operational circuit 210, in outline, processes the digital data in time series, analyzes the current waveform flowing through the signal line 107 as the voltage waveform, and, based on the analysis result, instructs the common electrode driving circuit 40 to increase or decrease the common voltage Vcom.

An operation of this operational circuit 210 will be described in detail.

Figure 5:
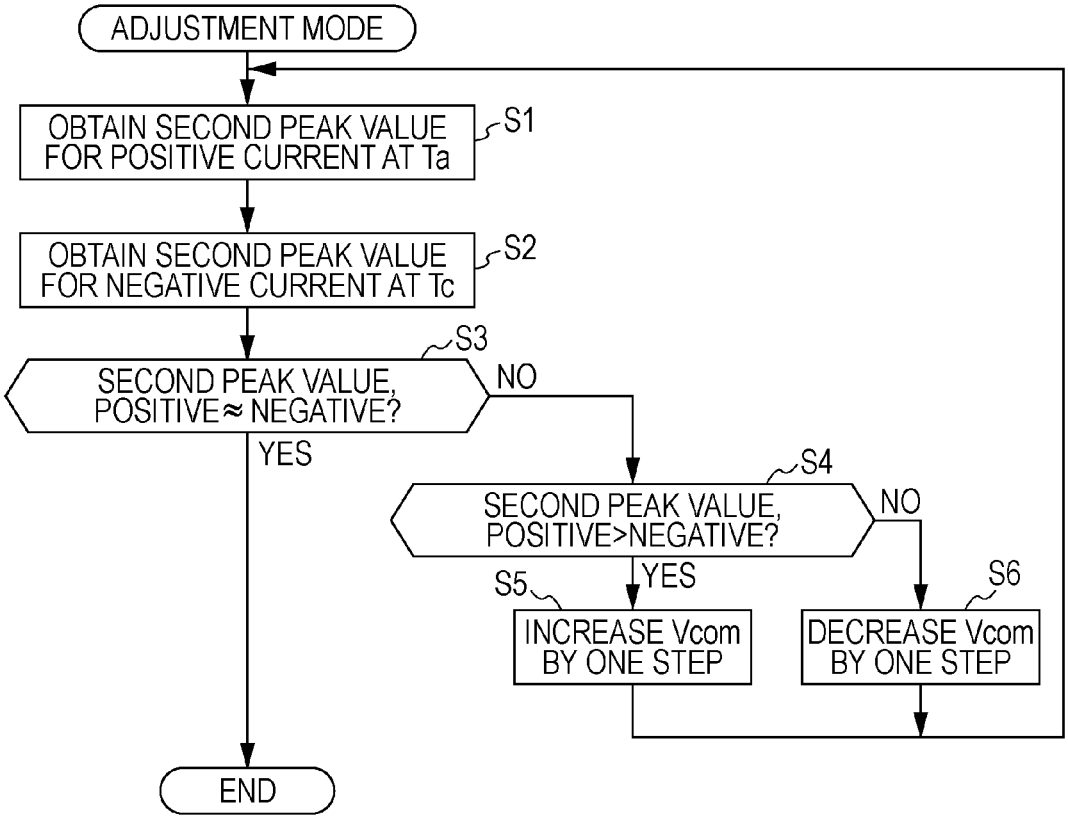
FIG. 5 is a flowchart illustrating an operation of an operational circuit in the same liquid crystal display.

FIG. 5 is a flowchart illustrating a processing operation by the operational circuit 210.

First, at step S1, the operational circuit 210 processes the digital data converted by the A/D conversion circuit 208, and obtains a peak value (second peak value) in the second peak appearing secondly from the start timing of the duration Ta of which the timing control circuit 202 has informed it, that is, obtains (a value corresponding to the absolute value of the current +Ia) in FIG. 4C. At step S2, the operational circuit 210 obtains a peak value in the second peak (a value corresponding to the absolute value of the current −Ic) appearing secondly from the start timing of the duration Tc in the same manner.

Next, the operational circuit 210, at step S3, determines whether or not the positive peak value and the negative peak value lie in a range where they can be considered not to be different from each other, that is, determines whether or not a difference therebetween lies in a threshold value.

When the difference lies in the threshold value, it means that the common voltage Vcom is suitable at present, so the operational circuit 210 informs the timing control circuit 202 of it, and finishes the processing. Thereby, timing control circuit 202 finishes the adjustment mode so as to return to the display mode (there may be a case of allowing the power-off).

On the contrary, if the difference exceeds the threshold value, the operational circuit 210, at step S4, determines whether or not the positive peak value is greater than the negative peak value.

Figure 6:
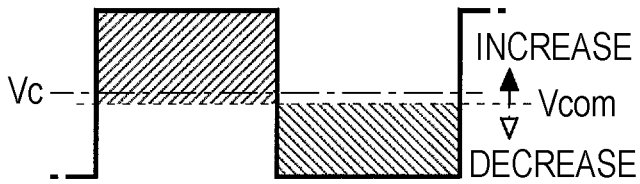
FIG. 6 is a diagram illustrating increase or decrease in a common voltage in the same liquid crystal display.

When the positive peak value is greater than the negative peak value, it means that the transmittance due to the application of the positive voltage Vg(+) to the pixel electrode 118 is greater than that due to the application of the negative voltage Vg(−) to the pixel electrode 118, and also indicates that a positive voltage effective value is greater than the a negative voltage effective value in the normally black mode. Thereby, at step S5, the operational circuit 210 instructs the common electrode driving circuit 40 to increase the common voltage Vcom by one step. In response to this instruction, the common electrode driving circuit 40 increases the common voltage Vcom by one step as marked with the arrow directing upwards in FIG. 6, and hence works so that the positive voltage effective value is decreased and the negative voltage effective value is increased.

In addition, at step S4, when the positive peak value is equal to or less than the negative peak value, it means that since the difference lies in the threshold value has been already excluded at step S3, the positive peak value is smaller than the negative peak value, that is, the positive voltage effective value is smaller than the negative voltage effective value. Thereby, at step S6, the operational circuit 210 instructs the common electrode driving circuit 40 to decrease the common voltage Vcom by one step. In response to this instruction, the common electrode driving circuit 40 decreases the common voltage Vcom by one step as marked with the arrow directing downwards in FIG. 6, and hence works so that the positive voltage effective value is increased and the negative voltage effective value is decreased.

After the instruction at step S5 or S6, the operational circuit 210 returns the method to step S1, and repeats the processes at steps S1 to S6 until the difference between the positive peak value and the negative peak value lies in the threshold value.

Therefore, when the adjustment mode is finished, the common voltage Vcom is controlled to be set to a voltage which enables the difference between the positive peak value and the negative peak value to lie in the threshold value in view of the absolute value, and thus flicker is reduced when transferred to the display mode.

According to this embodiment, the peak value in the second peak Ap at the duration Ta and the peak value in the second peak in the second peak Am at the duration Tc are specified based on the current waveform flowing through the common electrode, and the common voltage is controlled so that the difference therebetween lies in the threshold value. Thereby, this embodiment does not employ a light sensing element for detecting the transmittance or the reflectance for the liquid crystal elements, and furthermore the panel assembly 100 may adopt the product in the related art as it is.

A current flowing through a single liquid crystal element 120 is very small, but, in this embodiment, the peak values are found out based on the waveform of the current obtained by totally summing the currents flowing through the plurality of liquid crystal elements 120, and thus the detection accuracy can be increased.

In addition, although the peak values are compared with each other because this embodiment prioritizes the simplicity, the current waveform component excluding the first peak Ap(Am) is, as described above, generated due to the capacitance variation in the liquid crystal elements 120 at the duration Ta(Tc), and thus integral values of the currents excluding the first peaks may be compared with each other.

Second Embodiment

Figures 7A, 7B, 7C:
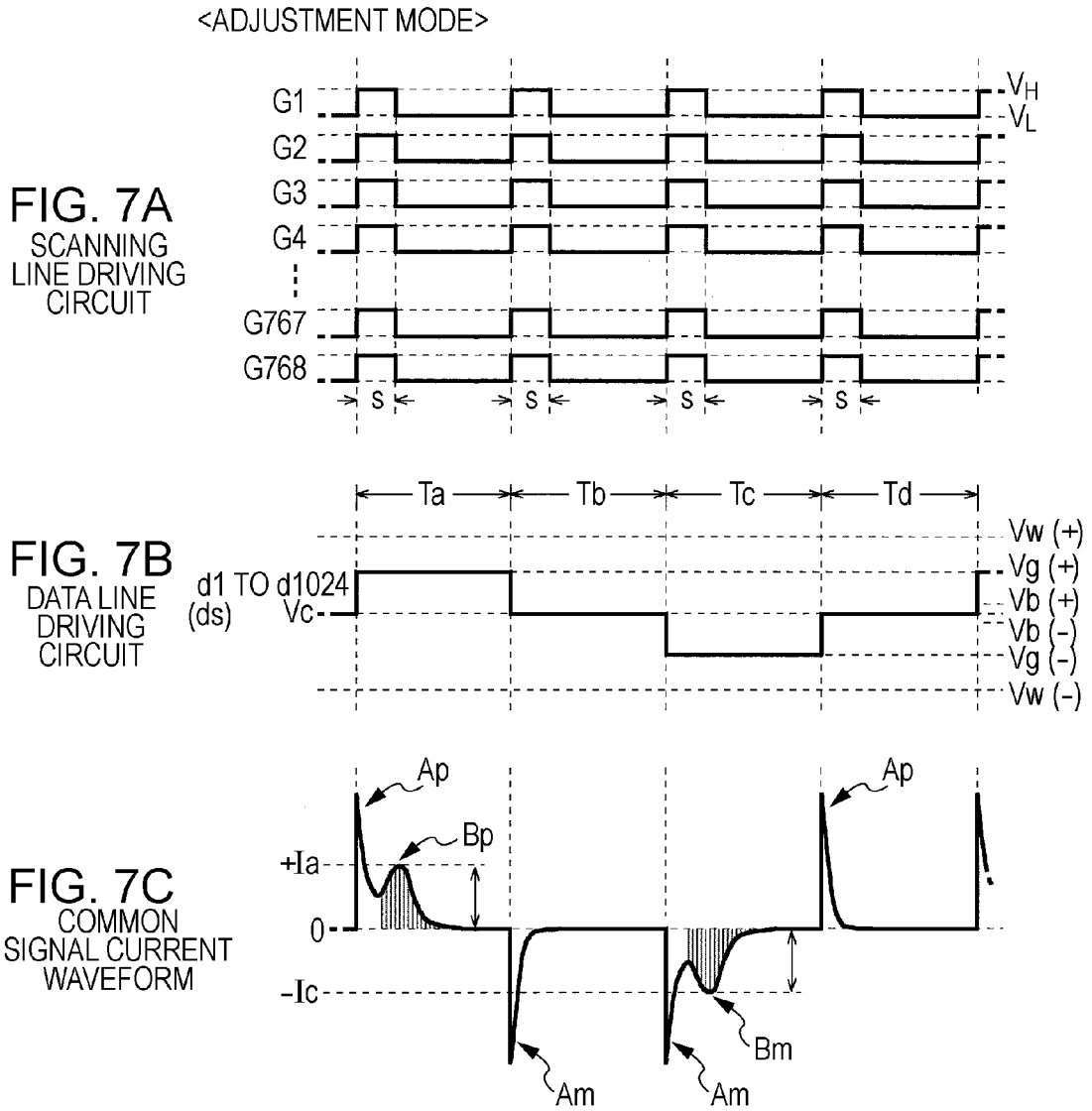
FIGS. 7A to 7C are diagrams illustrating an operation in an adjustment mode in a liquid crystal display according to a second embodiment.

Next, a second embodiment of the invention will be described. The second embodiment is the same as the first embodiment except that waveforms for the scanning signals G1 to G768 in the adjustment mode in the first embodiment are as shown in FIG. 7A.

In detail, in the adjustment mode in the second embodiment, the scanning signals G1 to G768 have the H level only for the time s from the start timings of the respective durations Ta, Tb, Tc, and Td and the L level for the remaining time.

As described above, the driving voltage for the liquid crystal element 120 is instantaneously varied relative to the voltage applied to the pixel electrode 118, and thereby although the scanning signal has the H level only for the time s, the difference between the voltage of the data signal and the voltage of the common signal is enough to be maintained in the liquid crystal elements 120.

Meanwhile, in the display mode, when the TFT 116 is turned on and thereafter turned off, there happens a phenomenon that a potential for the drain electrode (pixel electrode 118) is varied due to a parasitic capacitance between the gate electrode and the drain electrode (called pushdown, punch through, field through). When the TFT 116 is of n channel type, the potential direction variation for the drain electrode is varied to be decreased irrespective of its polarity.

Also, in the display mode, there is sometimes a case of having difficulty neglecting a tendency that the maintaining voltage in the liquid crystal element 120 is varied due to the off-leak in the TFT 116.

In the adjustment mode in the first embodiment, since the TFT 116 is always turned on, the pushdown or the off-leak has no influence on the voltage applied to the liquid crystal element 120 at the durations Ta and Tc. In contrast, in the adjustment mode in the second embodiment, the TFT 116 is turned off in the same manner as the display mode, the voltage applied to and maintained in the liquid crystal element 120 at the durations Ta and Tc is influenced by the pushdown or the off-leak.

For this reason, the current waveform detected at the durations Ta and Tb is also influenced by the pushdown or the off-leak.

Accordingly, the second embodiment controls the common voltage Vcom by the use of a value reflecting the influence of the pushdown or the off-leak, thereby reducing flicker with further accuracy.

Third Embodiment

Figure 8:
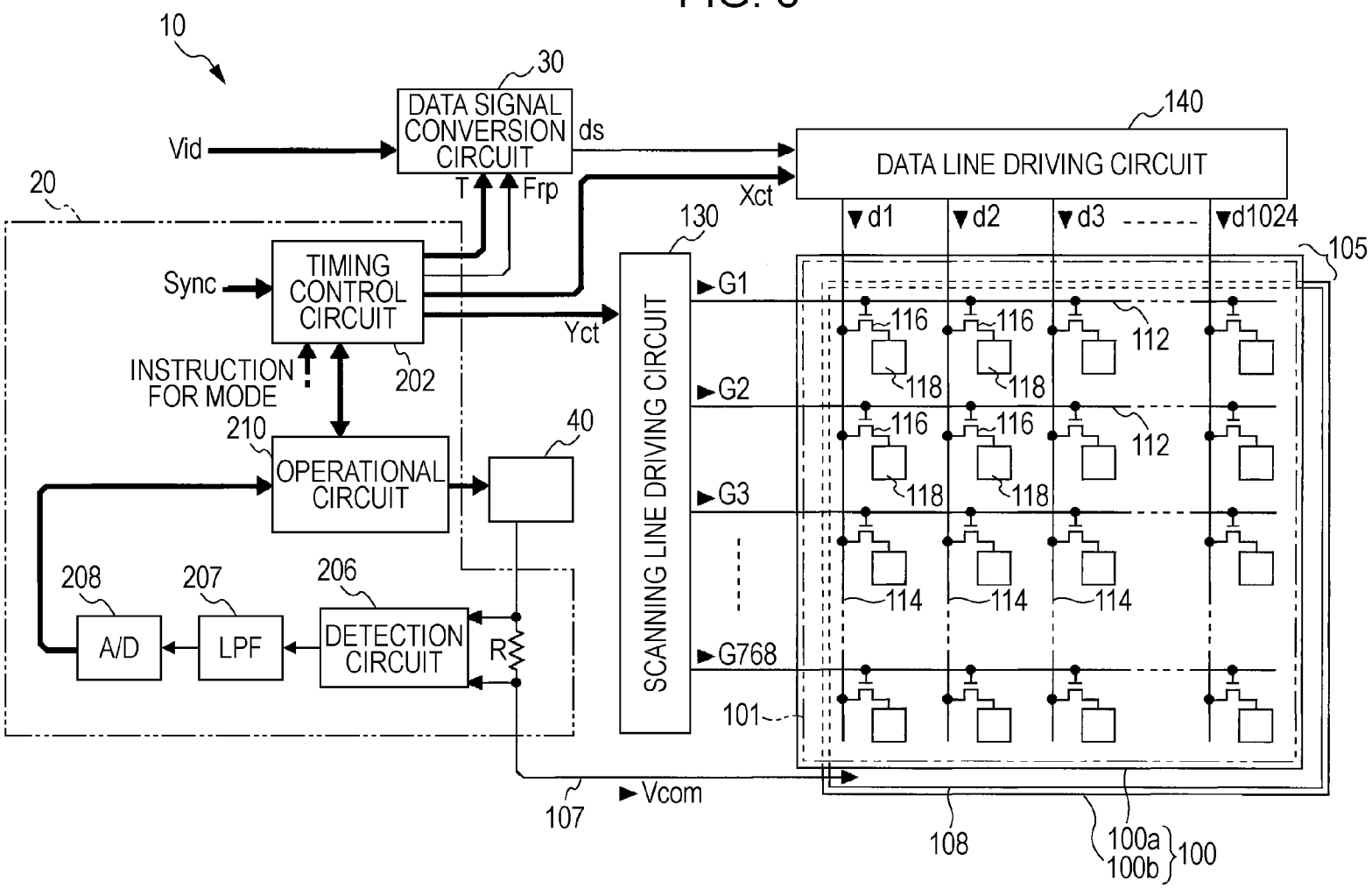
FIG. 8 is a block diagram illustrating a configuration of a liquid crystal display according to a third embodiment.
Figure 9A:
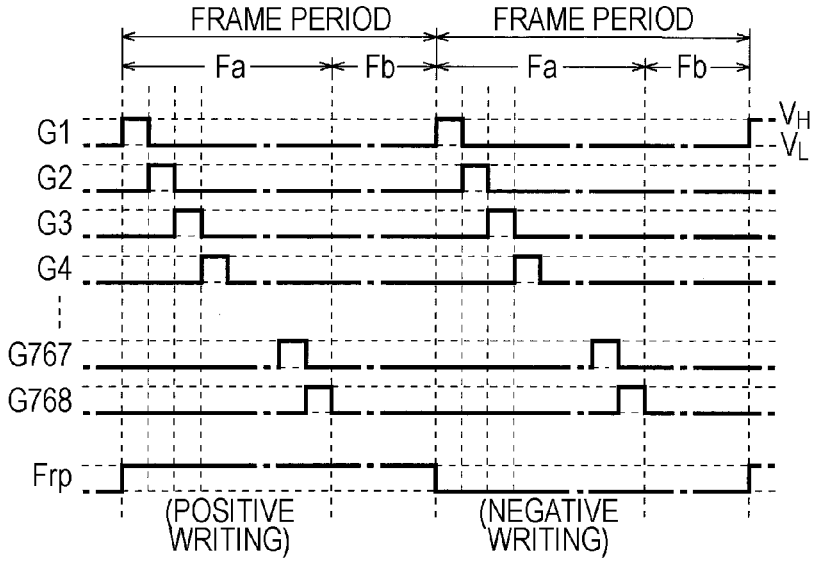
FIGS. 9A to 9C are diagrams illustrating an operation of the liquid crystal display according to the third embodiment.

A third embodiment of the invention will be described. In this third embodiment, as shown in FIG. 8, an LPF (low pass filter) 207 which passes only a low frequency component of the output signal of the detection circuit 206 is employed, and further the scanning line driving circuit 130 performs a line sequential driving in which the scanning lines are selected in the same order as the display mode without differentiation depending on the operation modes, as shown in FIG. 9A.

Figure 9B:
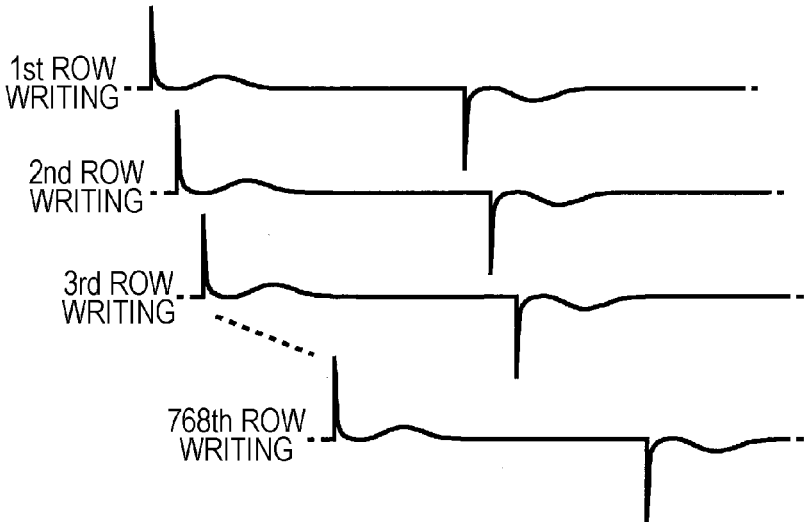
Figure 9C:
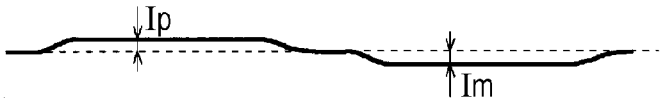

In such a line sequential driving, the waveform of the current flowing through the signal line 107 (more accurately, the waveform of the voltage converted from the current) is obtained by overlapping the respective current waveforms caused by the selection of each scanning line, that is, the respective current waveforms appearing when the scanning signals G1, G2, G3, . . . , and G768 become the H level, as shown in FIG. 9B wherein the current waveform is determined by a selection of each row. The instantaneous current component corresponding to the first peak in the overlapped waveforms has a high frequency and thus is cut by the LPF 207. Thereby, as shown in FIG. 9C, only an integral component for the second peak with a low frequency component is output from the LPF 207.

Therefore, the operational circuit 210 may respectively obtain, from digital data digitally converted from the output signal of LPF 207, an amplitude Ip of the integral component for the second peak due to the application of the positive voltage and an amplitude Im of the integral component for the second peak due to the application of the negative voltage, and instruct increase or decrease of the common voltage Vcom so that the obtained amplitude lies in a threshold value.

According to the third embodiment, in the same manner as the first embodiment, in addition to reducing flicker component without employing a light sensing element, there is no need for differentiating the operation modes in the scanning line driving circuit and furthermore there is no need for specifying the second peak through the waveform processing, compared with the first embodiment.

Fourth Embodiment

The fourth embodiment of the invention will be described. The liquid crystal elements 120 used to detect the current waveform are also used to perform display in the first (the second and third) embodiment; however, the liquid crystal elements are only used for detection (i.e., detection specialization) in the fourth embodiment.

Figure 10:
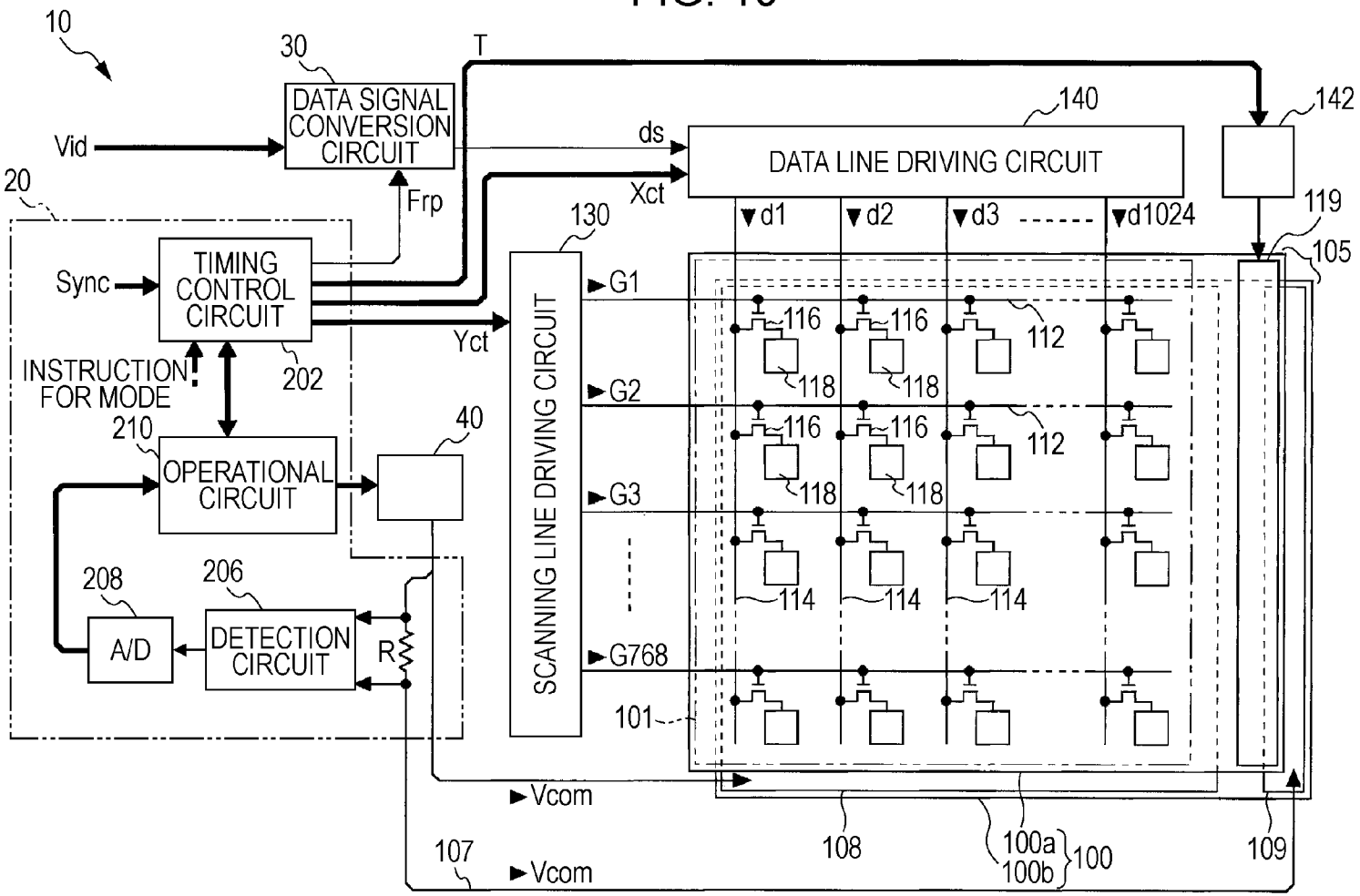
FIG. 10 is a diagram illustrating a configuration of a liquid crystal display according to a fourth embodiment.

As shown in FIG. 10, in the fourth embodiment, a first electrode 119 with a tetragonal shape, is provided outside the display area 101 on the rear face of the element panel 100*a*, and a second electrode 109 is provided on the opposite panel 100*b* so as to face the first electrode 119.

Thereby, the liquid crystal layer 105 is sandwiched by the first electrode 119 and the second electrode 109, and this is the same as the liquid crystal elements 120 in which the liquid crystal layer 105 is sandwiched by the pixel electrodes 118 and the common electrode 108. However, the liquid crystal elements in which the liquid crystal layer 105 is sandwiched by the first electrode 119 and the second electrode 109 are placed outside the display area 101, and thus are not recognized.

In the fourth embodiment, in response to the control signal T from the timing control circuit 202, the electrode driving circuit 142 supplies, for the first electrode 119, the same signal as the data signal ds (refer to FIG. 4B) in the adjustment mode in the first embodiment. In addition, the common electrode driving circuit 40 applies the common voltage Vcom, to the common electrode 108 via one signal line of two signal lines divided on the way, and to the second electrode 109 via the other signal line 107. The resistor R is interposed in the signal line 107 transmitting the common voltage Vcom to the second electrode 109. In the fourth embodiment, the electrode driving circuit 142 and the common electrode driving circuit 40 are circuits which drive the liquid crystal elements in which the liquid crystal layer 105 is sandwiched by the first electrode 119 and the second electrode 109.

In the fourth embodiment, the liquid crystal elements used to detect the current waveform are configured independently from the liquid crystal elements 120 placed in the display area 101. Thus, it is possible to enable the liquid crystal elements 120 in the display area 101 to perform a display operation based on the video signal Vid, and, at the same time, to enable the liquid crystal elements in which the liquid crystal layer 105 is sandwiched by the first electrode 119 and the second electrode 109 to perform a current detection operation.

For this reason, in the fourth embodiment, the liquid crystal elements 120 in the display area 101 perform the display operation and this has no influence on visible images, whereby it is possible to control the common voltage Vcom by the operational circuit 210.

Therefore, in the fourth embodiment, the effect that flicker component is reduced without employing a light sensing element can be achieved without having an influence on visible images.

In the respective embodiments, the liquid crystal elements 120 are not limited to a transmissive type, but may also be a reflective type and also are not limited to a normally black mode, but may be a normally white mode.

Electronic Device

Figure 11:
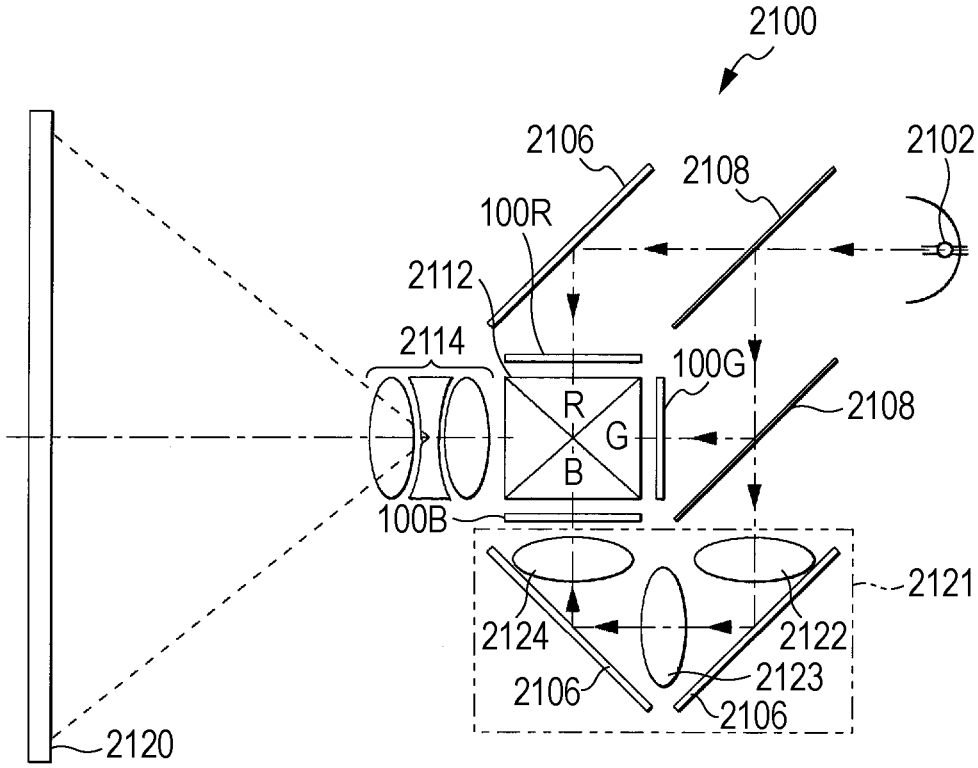
FIG. 11 is a diagram illustrating a projector which employs the liquid crystal display according to the embodiments.

As an example of an electronic device employing the LCD according to the above-described embodiments, a projector which uses the panel assembly 100 as a light valve will be described. FIG. 11 is a plan view illustrating a configuration of the projector.

As shown in this figure, a lamp unit 2102 including a white light source such as a halogen lamp or the like is provided in the projector 2100. Light emitted from the lamp unit 2102 is divided into light components of three primary colors of R (red) color, G (green) color, and B (blue) color, by three mirrors 2106 and two dichroic mirrors 2108 disposed in its inner side, and is guided to light valves 100R, 100G and 100B corresponding to the respective primary colors. The light of B color has in comparison a longer light path than that of the R color or the G color, and thus, for prevention of its loss, it is guided to a relay lens system 2121 including a light-incident lens 2122, a relay lens 2123, and a light-exciting lens 2124.

In this projector 2100, the LCD having the panel assembly 100 is provided in three sets corresponding to the respective R color, G color and B color. Each of the light valves 100R, 100G and 100B has the same configuration as the above-described panel assembly 100. A video signal corresponding to each primary color of the R color, G color and B color is supplied from an external device, so as to drive each of the light valves 100R, 100G and 100B.

The light components respectively modulated by the light valves 100R, 100G and 100B are incident to a dichroic prism 2112 in three directions. In this dichroic prism 2112, the light components of the R color and the B color are refracted by 90 degrees, whereas the light of the G color travels straight. Thereby, images of the respective primary colors are combined, and then a color image is projected on a screen 2120 by a projection lens 2114.

Since the light components respectively corresponding to the R color, the G color and the B color are incident to the light valves 100R, 100G and 100B by the dichroic mirror 2108, color filters are not required. In addition, the transmission images from the light valves 100R and 100B are projected after reflected from the dichroic prism 2112, whereas the transmission image from the light valve 100G is projected as it is, and thus the horizontal scanning direction for the light valves 100R and 100B is made to be optimally reverse to that for the light valve 100G, so as to display bilaterally inverted images.

As the electronic device, in addition to the projector described referring to FIG. 11, there are, for example, a television set, a view finder type monitor/direct view type video tape recorder, a car navigation device, a pager, an electronic diary, an electronic calculator, a word processor, a workstation, a television-phone, a POS terminal, a digital still camera, a mobile phone, and a device having a touch panel, and so forth. It is apparent that the above-described electro-optical device is applicable to the various kinds of electronic devices.

The entire disclosure of Japanese Patent Application No. 2009-133790, filed Jun. 3, 2009 is expressly incorporated by reference herein.

What is claimed is:

1. A liquid crystal display comprising:

liquid crystal elements, in each of which a liquid crystal layer is sandwiched by a first electrode and a second electrode;

a driving circuit configured to alternately apply higher and lower voltages than a predetermined voltage to the first electrode, and, at the same time, to apply the predetermined voltage to the second electrode; and a control circuit configured to compare a first current with a second current, the first current being obtained by excluding an instantaneous current due to application of a related higher voltage from currents flowing through the second electrode after the higher voltage is applied to the first electrode and identifying a second higher current peak appearing from the time of the application of the higher voltage, and the second current being obtained by excluding an instantaneous current due to application of a related lower voltage from currents flowing through the second electrode after the lower voltage is applied to the first electrode and identifying a second lower current peak appearing from the time of the application of the lower voltage, comparing the second higher current peak and the second lower current peak, determining whether a difference between the second higher current peak and the second lower current peak is within a predetermined threshold value, and if the difference between the second higher current peak and second lower current peak is within the predetermined threshold value, maintaining a level of the predetermined voltage, whereas if the difference exceeds the predetermined threshold value, determining if the second higher current peak is greater than the second lower current peak and if the second higher current peak is greater than the second lower current peak, increasing the level of the predetermined voltage and if the second higher current peak is equal to or less than the second lower current peak, decreasing the level of the predetermined voltage.

2. The liquid crystal display according to claim 1, wherein the driving circuit is configured to apply a reset voltage for resetting a potential between the first electrode and the second electrode before applying the higher voltage or the lower voltage.

3. The liquid crystal display according to claim 1, wherein the control circuit comprises a resistor interposed in a signal line which transmits the predetermined voltage to the second electrode; and a detection circuit detecting a voltage across the resistor, and wherein the control circuit is configured to specify a current flowing through the second electrode based on the across-voltage detected by the detection circuit.

4. The liquid crystal display according to claim 3, wherein the control circuit further comprises a low pass filter filtering the across-voltage detected by the detection circuit.

5. The liquid crystal display according to claim 1, wherein the first electrode is a pixel electrode which is coupled to a data line via a switching element turned on when a scanning line is selected, and the second electrode is a common electrode, wherein the driving circuit includes:

a scanning line driving circuit selecting the scanning line;

a data line driving circuit supplying a data signal for the data line when the scanning line is selected; and a common electrode driving circuit supplying the predetermined voltage for the common electrode.

6. The liquid crystal display according to claim 1, wherein the control circuit is configured to detect a current flowing through the second electrode in relation to the liquid crystal elements disposed in an area other than a display area.

7. An electronic device display comprising the liquid crystal display according to claim 1.

* * * * *